US010378205B2

(12) United States Patent
Levin

(10) Patent No.: US 10,378,205 B2
(45) Date of Patent: Aug. 13, 2019

(54) CURTAIN WALL FRAME

(71) Applicant: PROFAL LTD., Goren (IL)

(72) Inventor: Yair Levin, Goren (IL)

( * ) Notice: Subject to any disclaimer, the term of this patent is extended or adjusted under 35 U.S.C. 154(b) by 0 days.

(21) Appl. No.: 15/761,492

(22) PCT Filed: Aug. 29, 2016

(86) PCT No.: PCT/IL2016/050943
§ 371 (c)(1),
(2) Date: Mar. 20, 2018

(87) PCT Pub. No.: WO2017/093994
PCT Pub. Date: Jun. 8, 2017

(65) Prior Publication Data

US 2018/0274232 A1 Sep. 27, 2018

(30) Foreign Application Priority Data

Dec. 2, 2015 (IL) ..... 242894

(51) Int. Cl.
*E04B 2/96* (2006.01)

(52) U.S. Cl.
CPC ..... *E04B 2/967* (2013.01)

(58) Field of Classification Search
CPC ..... E04B 2/967
(Continued)

(56) References Cited

U.S. PATENT DOCUMENTS 3,038,568 A * 6/1962 Morgan ..... E04B 2/90 52/204.7
3,509,674 A * 5/1970 Birum, Jr. ..... E04B 2/967 52/302.1

(Continued)

FOREIGN PATENT DOCUMENTS

CN 102953477 A 3/2013
DE 11088886 B 6/1961

(Continued)

OTHER PUBLICATIONS

International Search Report PCT/IL2016/050943 Completed Dec. 6, 2016; dated Dec. 11, 2016 3 pages.

(Continued)

*Primary Examiner* — Joshua K Ihezie
(74) *Attorney, Agent, or Firm* — The Roy Gross Law Firm, LLC; Roy Gross

(57) ABSTRACT

The invention comprises a two-part support member for curtain walls capable of withstanding the extreme loads required for extra-large walls with minimal deformation comprising two independently extrudable components, each of which may be produced on standard extruders and attachment means that holds the extrudable components together. The sections fit together in such a way that inevitable deformations that occur during production are taken into account and corrected for. Due to the hitherto unattainable stiffness values that this combination of components may reach, extra-large curtain walls mounting and supporting is achieved that was otherwise unattainable. The cross sectional area of the sections is relatively small allowing for lightweight members to be extruded that use a minimum of material.

9 Claims, 6 Drawing Sheets

(58) Field of Classification Search
USPC ..... 52/208, 235, 284, 395, 463, 464, 466, 52/467, 468, 506.06
See application file for complete search history.

(56) References Cited

U.S. PATENT DOCUMENTS

| | | | | | |
|---|---|---|---|---|---|
| 3,699,735 | A | | 10/1972 | Smith | |
| 3,978,629 | A | * | 9/1976 | Echols, Sr. | E04B 2/967 52/235 |
| 4,650,702 | A | * | 3/1987 | Whitmyer | E06B 3/5427 428/31 |
| 4,680,905 | A | * | 7/1987 | Rockar | E04D 3/08 52/200 |
| 4,691,489 | A | * | 9/1987 | Shea, Jr. | E06B 3/5427 52/204.593 |
| 4,738,065 | A | * | 4/1988 | Crandell | E06B 3/5427 52/235 |
| 4,850,167 | A | * | 7/1989 | Beard | E04B 1/0046 52/200 |
| 4,903,454 | A | * | 2/1990 | Rose | E04B 2/96 52/235 |
| 5,355,645 | A | * | 10/1994 | Farag | E04B 2/96 52/235 |
| 5,546,713 | A | * | 8/1996 | Voegele, Jr. | E04D 3/08 52/202 |
| 5,592,795 | A | * | 1/1997 | Rinehart | E04B 2/967 52/204.591 |
| 6,745,527 | B1 | * | 6/2004 | Sherman | E04B 2/96 52/235 |
| 6,748,709 | B1 | * | 6/2004 | Sherman | E04B 2/96 52/235 |
| 6,804,920 | B2 | * | 10/2004 | Hogan | E04B 2/96 52/204.5 |
| 8,011,146 | B2 | * | 9/2011 | Krause | F41H 5/263 52/235 |
| 9,212,482 | B2 | * | 12/2015 | Frederick | E04B 2/965 |
| 9,683,376 | B2 | * | 6/2017 | Zahner | E04F 19/02 |
| 2006/0201084 | A1 | * | 9/2006 | Arias | E04B 2/965 52/235 |
| 2008/0134610 | A1 | * | 6/2008 | Jakob-Bamberg | E04B 2/7448 52/489.1 |
| 2010/0212238 | A1 | * | 8/2010 | Voegele, Jr. | E04B 2/967 52/204.595 |
| 2010/0293882 | A1 | * | 11/2010 | Labrecque | E04B 2/967 52/705 |
| 2011/0113706 | A1 | * | 5/2011 | Krause | F41H 5/263 52/204.5 |
| 2011/0296775 | A1 | * | 12/2011 | Dolby | E06B 3/5427 52/204.6 |
| 2016/0069073 | A1 | * | 3/2016 | Grise | E04B 2/967 52/235 |

FOREIGN PATENT DOCUMENTS

| | | | |
|---|---|---|---|
| DE | 20009014215 | U1 | 3/2011 |
| GB | 2490011 | A | 10/2012 |

OTHER PUBLICATIONS

Written Opinion of the International Searching Authority PCT/IL2016/050943 dated Dec. 11, 2016 4 pages.
Extended European Search Report for EP 16870115.0-1005 (PCT/IL2016050943) Completed May 23, 2018; dated May 29, 2018 8 pages.

* cited by examiner

CURTAIN WALL FRAME

CROSS-REFERENCE TO RELATED PATENT APPLICATIONS

This application is a National Phase of PCT Patent Application No. PCT/IL2016/050943 having International filing date of Aug. 29, 2016, which claims the benefit of priority of IL 242894, filed Dec. 2, 2015. The contents of the above applications are all incorporated by reference as if fully set forth herein in their entirety.

FIELD OF THE INVENTION

The present invention relates to the field of curtain walls.

BACKGROUND OF THE INVENTION

Curtain walls are non-structural walls usually on the outside of a building. We use the term 'nonstructural' in the sense that these walls does not carry any load from the building other than their own. Due to this freedom from loading constraints, curtain walls can be made of lightweight materials such as glass, plaster, MDF, or the like instead of iron or concrete as most load-bearing walls are.

In the case of an outer curtain wall, the wall does have to resist wind loads and transfer these to the main building structure. These loads are transferred through connections at floors or columns of the building which hold the curtain wall (such as large panes of glass) in place, through vertical and/or horizontal structures made to hold the curtain walls in place.

Generally, in order to resist direct wind loads, the curtain walls must be connected to the building structure with support members that provide sufficient stiffness to minimize deformations. These support members transfer forces on the curtain wall to the concrete or iron of the building structure, such as at columns or floors of the building.

A typical curtain wall size corresponds with the story height of most office buildings, but when constructing a lobby, penthouse, hall or other structure with high ceilings, the support structures used for typical height curtain walls no longer suffice. For aesthetic effect, the curtain wall preferably spans large heights, in some cases reaching as much as 9 meters in height with single panes of glass.

There is thus a longstanding need for a curtain wall support member adapted to support extraordinarily large curtain walls.

There are many unique challenges for providing such a unique support member. As the window size grows in height and therefore in area, the loads that must be transferred by the support members grow correspondingly, and thus extra-large curtain walls (which may reach several stories in height, with several meters between support members horizontally and possibly surpassing 9 meters in the vertical direction) have extreme requirements for the stiffness of their support members.

To appreciate the challenges of designing a support member of high stiffness values, consider the deformation of a beam under uniform load, as an approximation to the duty that the support members will serve.

This maximum deflection δ as a function of total load P, distance between anchoring points L, modulus of elasticity E, and moment of inertia I is given by $$\delta = N\frac{PL^3}{EI}$$

The loading P depends on the area of the curtain wall and hence on the first power of L, such that the final dependence of deflection on L is in fact of the fourth power. This causes a dramatic increase of required moment as a function of curtain height; for a curtain of twice the height, the moment required will increase by 2^4 or a factor of 16. High values of L (e.g. 9 meters or more) are in demand, and therefore the moment I must be correspondingly high to keep the deflection to acceptable values. As a practical example, an aluminum support member (of modulus ~70 GPa) having approximately 7 meters between its own anchoring points (where it is held by concrete, steel, or other structural building elements) will require a moment of over 10,000 cm^4 to keep its maximum deflection δ to an acceptable level of 4 cm.

This challenge is only exacerbated where very high curtain walls that have high L values are desired.

For this purpose, replacing the aluminum material is often attempted in the industry but it also introduces many disadvantages:

(a) Aluminum is a very abundant, easy to produce, and theoretically 100% recyclable material. Replacing aluminum would involve higher production costs resulting from the usage of more valuable and difficult materials;

(b) Aluminum is easily extruded using well-known processes, to produce linear forms of nearly unlimited cross-section design.

(c) Aluminum is a durable and visually appealing material. Replacing aluminum would most often result in a coarse and un-esthetic visual look to the curtain wall. The aesthetic requirement is emphasized where extraordinarily high lobbies are constructed incorporating extra-large curtain walls.

Therefore, there is a need for a solution that would sustain an acceptable deflection δ range and would provide a support member with an acceptable stiffness, without changing the material completely, for example, by use of designs having high moment of inertia I values.

There are various designs for such support members. For the sake of convenience we shall demonstrate these design challenges with a typical prior art I-beam shaped support member (FIG. 3).

As can be seen, the I-beam support member is comprised of 2 relatively thick, parallel, and distant flanges (301*a-b*) where the glass (304) is mounted upon one of the flanges. The I-beam support member is further comprised of a relatively long web that determines the distance of said flanges, and a holding cap (303) that is responsible for holding the window glass (304) attached to the support member. As will be obvious to one skilled in the art, wind forces (305*a-b*) will generally cause loads towards the building but will also sometimes tend to pull the windows away from the building due to 'lift' of wind perpendicular to the building surface, and therefore the curtain-wall support member must deal with loads in both directions.

As is known by the average person in the art, the most efficient way to increase the moment of inertia of the support member is to increase the web (302) length.

However in the case of extruded members a practical limit of around 30 cm maximum member thickness is reached, since aluminum extruders generally use dies of this diameter and cannot produce items of greater transverse dimensions. While larger dies can be constructed, machines adapted to use them are not generally available and hence this size represents a practical limit in terms of cost of production.

Furthermore, elongating the web, instead of increasing the web thickness (which is not an effective means for increasing the moment of inertia of the member), would create a thin proportioned support member, ultimately degrading the support member's stability by introducing a 'wobbling' effect to the web which will lead to further deformation.

Due to these reasons, curtain walls manufacturers not only increase the support member web length (302) but also increase the flanges' (301*a-b*) thickness that has a secondary impact on the moment of inertia. Nevertheless, designs following this standard design doctrine have practical drawbacks and limitations, for instance namely that unreasonable flange thickness, produces high material requirements and ultimately results in high weight and high materials bill.

Furthermore, due to the 30 cm common extruder limit increasing flange thickness too much comes at the expense of web length, resulting in an inefficient and ineffective disproportionate support member.

Additionally, standard extruders have a practical limit of approximately 130 kg extrusion mass. Therefore, even by disproportionately thickening the support member's flanges, the extruder mass limit will be quickly reached and the required 7 meter long support member with moment of over 10,000 cm^4 will still be unattainable.

To emphasize this point, consider a disproportionately thick flanged support member design having the required moment of 10,000 cm^4. Due to the extruder mass limit, the support member will fall short of the required total length. Under its mass limit, the extruder would only be able to produce a short support member (e.g. 4 meter long member instead of the required 8 meter length) for which much lower moment values suffice.

There is a further practical limitation involving the length and the weight of the extrusions. The transportation and handling of regular curtain wall support members, is already a difficult task and it becomes even more severe, with extra-large support members which are only available through import and naval transportation from countries with suitable massive extruders. In these cases there is a need for a suitable logistical framework and specialized loading and handling methods.

Needless to say that these logistical obstacles greatly increase costs and also prolong delivery times.

Therefore a there is still a long-felt need for a support member that is capable of supporting extra-large curtain walls while not requiring arbitrarily large extrusion sizes and also avoiding transportation and manufacturing related practical limitations

SUMMARY OF THE INVENTION

The invention comprises a two-part support member for curtain walls capable of withstanding the extreme loads required for extra-large walls with minimal deformation.

Each part may be an independent extrusion that can be produced on standard extruders. The sections fit and are locked together in such a way that inevitable deformations that occur during production are taken into account and corrected for. Together these sections form a single effective unit whose length may exceed the limit of standard extruded parts.

The sections are held together by attachment means, which is adapted to hold the support member parts in compression. Such a compression is attainable by such attachment means as a threaded rod screwing into a captive nut or threaded section of one of the extrusions.

It is within the provision of the invention that said attachment means have a higher elastic modulus than the material of the support member components (e.g., a steel bolt holding together aluminum sections).

It is within the provision of the invention that the support member is comprised of more than 2 parts connected in compression to each other. This feature enables producing support members from multiple smaller-diameter aluminum dies.

It is within the provision of the invention that the support member have thickened flanges for an increased moment of inertia value.

The inventive combination of a two-part support member held in compression by said attachment means enables two sections to be used instead of one, introducing a support member with a moment of inertia that greatly exceed that achievable in standard extrusions. Each section contributes to the overall moment of the support member.

The support member of this invention presents a combination of several simple components that work in synergy providing many advantages over the prior art:

(a) Producing support members from 2 constituent components enables attaining longer support members resulting in higher moment of inertia and stiffness values than was previously plausible with support members extruded from single aluminum dies.

(b) Due to the introduction of longer support members, there is no need for disproportionately large support member flanges, resulting in lower weight and a lower material bill compared to other known support members.

(c) As was mentioned above, disproportionately thickening the support member's flanges to achieve a moments of over 10,000 cm^4 was unattainable due to the 130 kg extrusion mass limit of standard extruders. Now, due to the modularity of the inventive support member, extra-long support members with said moment of inertia values become achievable with standard extruders.

(d) The modularity of the inventive support member allows for avoiding previous practical limitations common when importing, transporting and manufacturing extra-large support members; mainly alleviating the requirement for extra-large extruders and allowing transportation with a regular logistical framework.

(e) The Introduction of the attachment means, not only used to hold together the two support member parts, but also holds both parts in compression, thus preventing instability and deformation issues from unreasonably elongated and thin proportioned support member designs.

(f) The attachment means also optionally incorporates a component with higher elasticity modulus further contributing to the member's stiffness.

BRIEF DESCRIPTION OF THE DRAWINGS

Embodiments and features of the present invention are described herein in conjunction with the following drawings.

DETAILED DESCRIPTION OF PREFERRED EMBODIMENTS

The present invention will be understood from the following detailed description of preferred embodiments, which are meant to be descriptive and not limiting. For the sake of brevity, some well-known features, methods, systems, procedures, components, circuits, and so on, are not described in detail.

Figure 1:
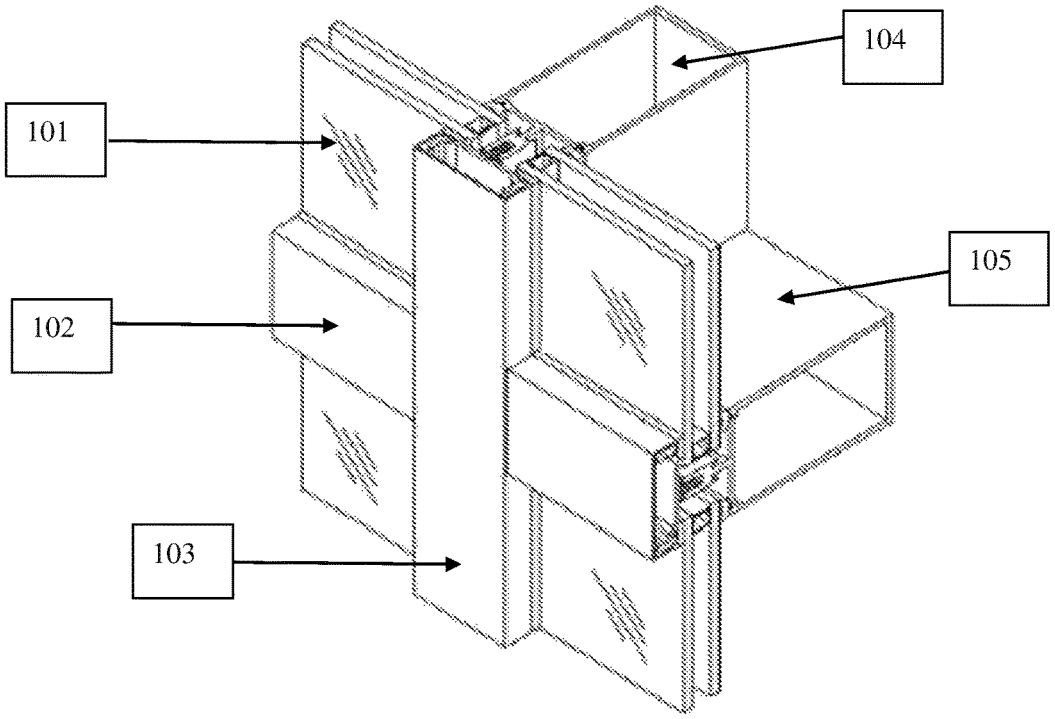
FIG. 1 shows a standard curtain window support system.
Figure 2:
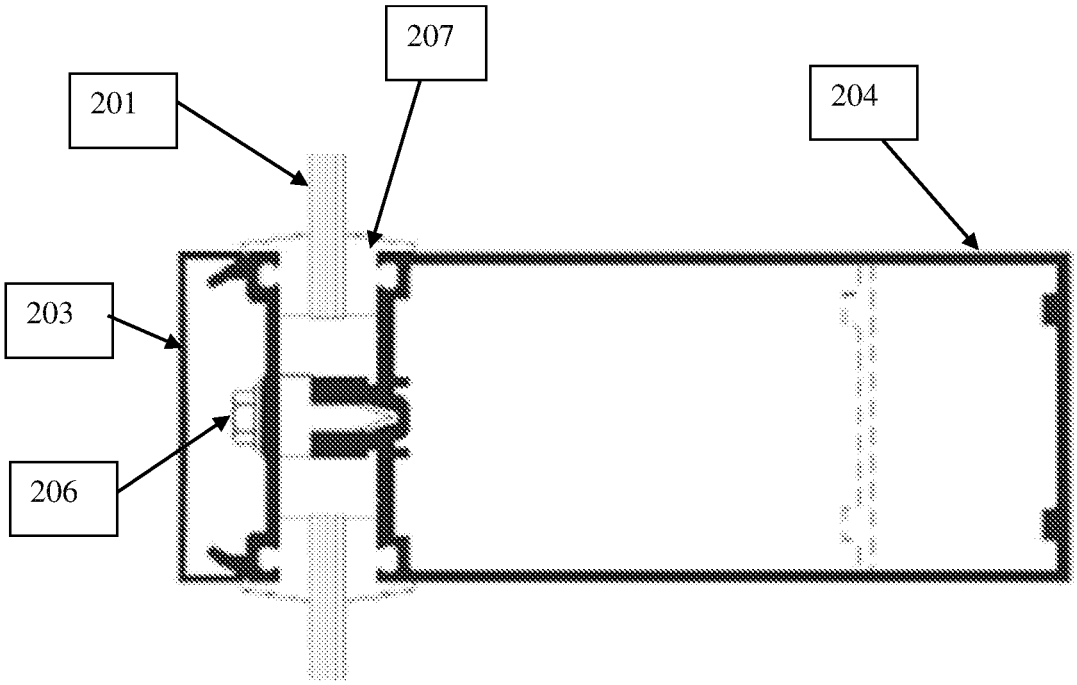
FIG. 2 shows the system of FIG. 1 in cross section.
Figure 3:
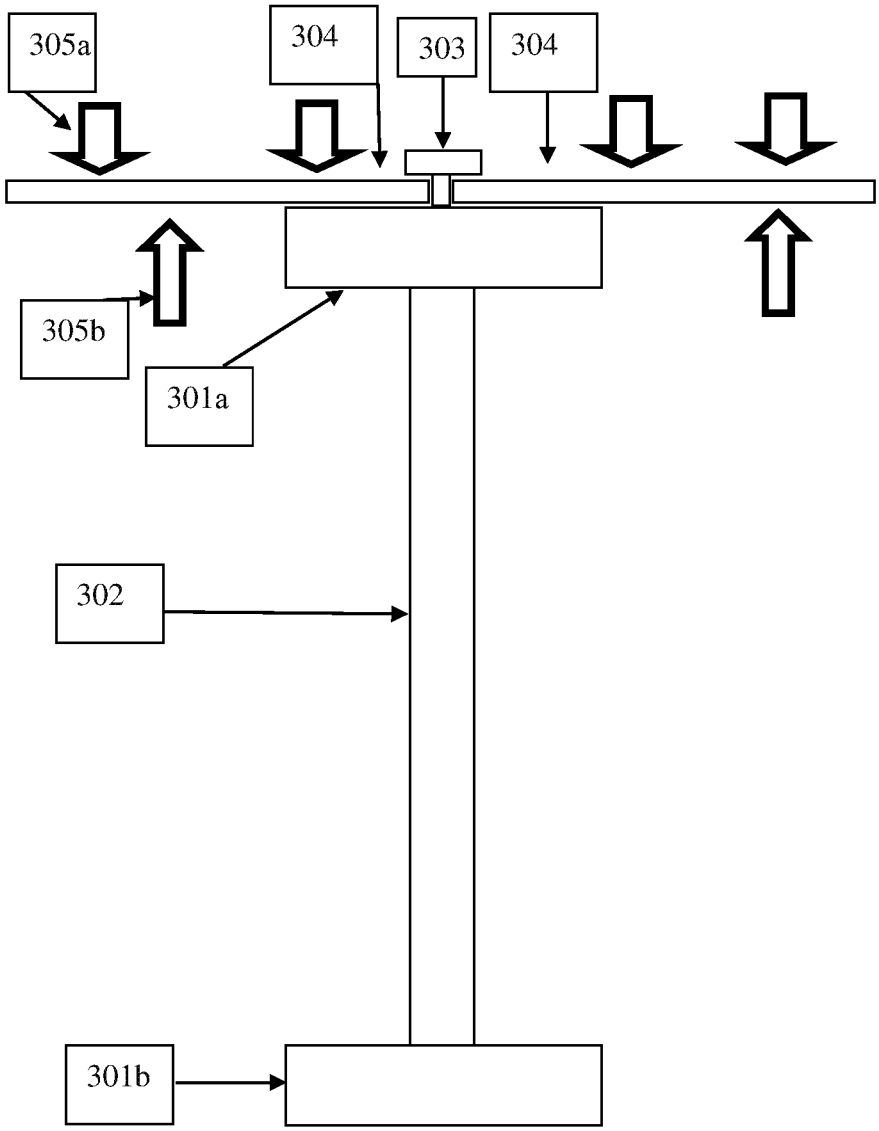
FIG. 3 shows a cross section of I-beam Shaped support member (prior art).

A standard support is shown in FIGS. 1,2.

Here the glass panes 101 are shown, held in place by horizontal transom and vertical mullion extruded rear support members 104,105 respectively. The panes are held in tension between these rear members 104,105 and holding caps 102,103 which are generally attached to the rear members by means of screws or the like concealed within the members.

FIG. 2 shows the same support members in section. Here the bolt 206 holding the rear support 204 to the holding cap 203 is visible. This bolt holds the rear support and the holding cap together and thereby compresses the window section 201 between flexible abutting members 207 which may be for instance of rubber, silicone or the like.

As can be seen and as was previously explained, the illustrated prior art support member is elongated having thin proportions with 2 thick flanges. While this design is suitable for standard curtain walls, it has lower moment of inertia values than is suitable for large dimensioned curtain walls.

Figure 4:
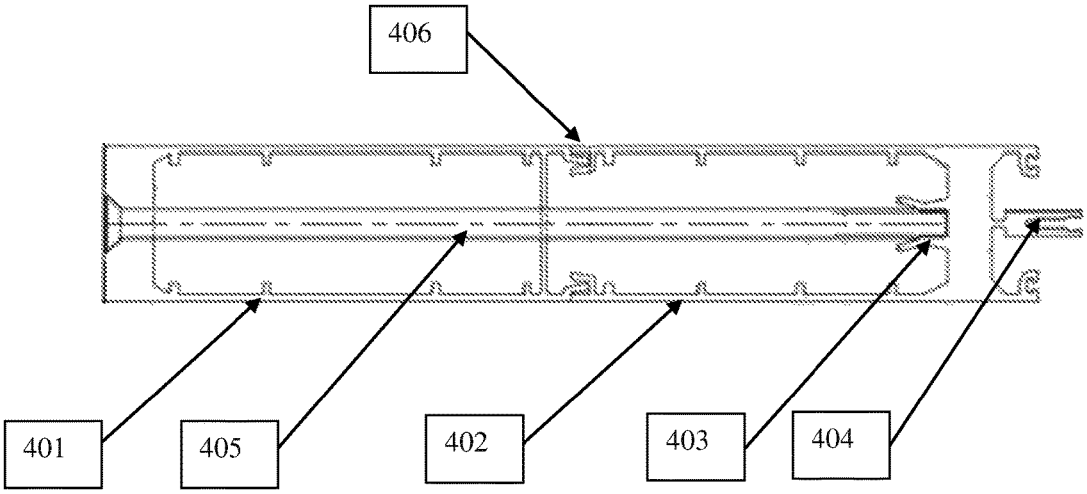
FIG. 4 shows an embodiment of the invention in cross section.

FIG. 4 shows a cross-section of an embodiment of the invention. Here, first and second parts 401, 402 of the device are seen; each of these may be extruded separately and thus each may in principle reach up to the maximum extrusion size and weight of the available extruder, and together of course the total length and weight may exceed known support members by a considerable amount.

These parts fit together by means of the hermaphroditic tongue-in-groove or dovetail 406 which tends to force the sections into alignment when the parts are forced into contact. This force is achieved by means of the bolt or threaded rod 405, which is held by the section 401 on the first part and screws into the threaded section 403 of the second part. A second threaded section 404 allows for attachment of the front holding cap (not seen).

Due to the fact that the sections are held in compression by the bolt or threaded rod 405, and due to the fact that the material thereof has higher elastic modulus than the material of the device, the total stiffness of the device will increase over what would otherwise be achievable.

Figure 5:
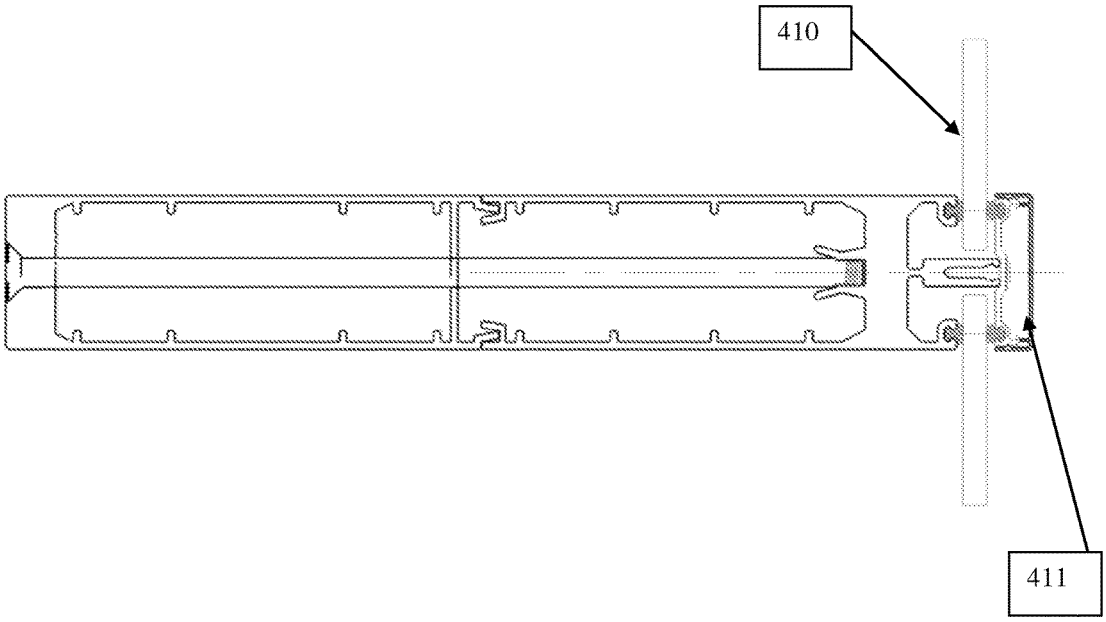
FIG. 5 shows the embodiment of FIG. 4 with further detail.

FIG. 5 shows a cross-section of an embodiment of the invention as in FIG. 4, with the addition of the glass pane 410 being held, and the bolt holding the holding cap 411 and the back support member together and hence holding the glass 410 in compression.

Figure 6:
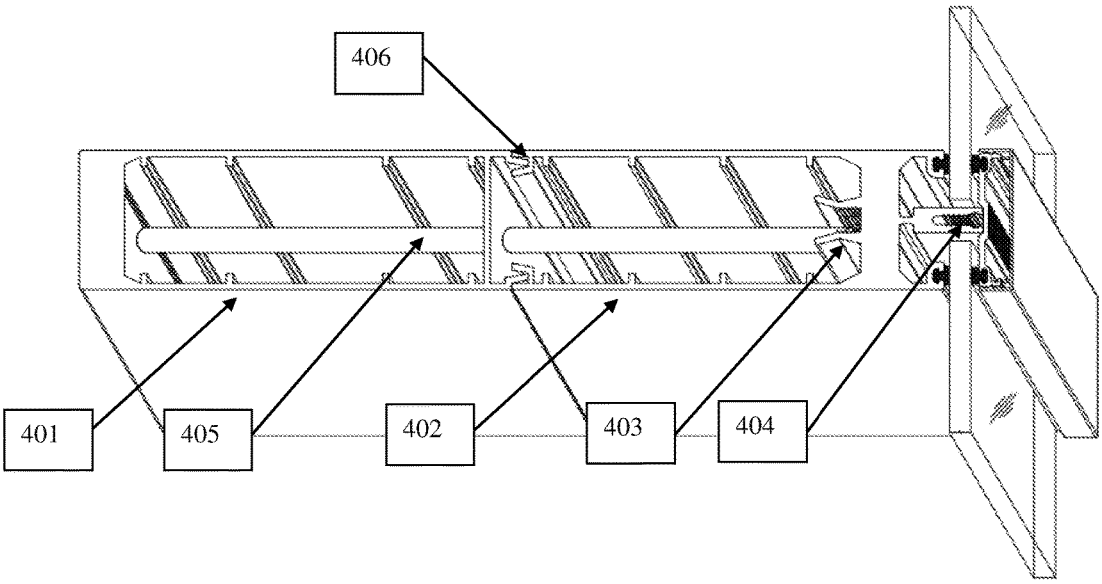
FIG. 6 shows a perspective view of an embodiment of the invention.

FIG. 6 shows a perspective view of one embodiment of the device, with two constituent sections 401 and 402 held together by bolt 405 which screws into the threading 403 provided in one of the constituent sections.

The foregoing description and illustrations of the embodiments of the invention has been presented for the purposes of illustration. It is not intended to be exhaustive or to limit the invention to the above description in any form. Furthermore just as every particular reference may embody particular methods/systems, yet not require such, ultimately such teaching is meant for all expressions notwithstanding the use of particular embodiments.

Any term that has been defined above and used in the claims, should be interpreted according to this definition.

The invention claimed is:

1. A support member for curtain walls comprising a front holding cap and a back support section, wherein said back support section is comprised of:

(a) a first support member component and a second support member component forming a multi-component support section, wherein, said first and said second support member components fit one another and are locked together, wherein said first support member component has a first flange and a second flange, and wherein said second support member component has a third flange and a fourth flange, wherein when said first and said second support member components are locked together, said first flange and said third flange interlock and said second flange and said fourth flange interlock;

(b) an attachment means that holds said first and second support member components in compression, said attachment means is a threaded fastener inserted through a support member component in a parallel manner to the support member length, and screwed in compression into a threaded section in the other support member component;

(c) wherein said support member allows for increased values of moment of inertia and stiffness to be reached, enabling the support of extra-large curtain walls with a minimum of deformation.

2. The support member of claim 1, further comprising at least 1 additional support member component, attached to said first and second support member components in compression by said attachment means.

3. The support member of claim 1, wherein said support member components having thickened flanges for an increased moment of inertia.

4. The support member of claim 1, wherein said first and second support member components are held in compression by means of a bolt whose head is held by said first member, said bolt being screwed into a threaded section of said second member, thereby holding said first and second member in compression with one another and thus further increasing the mechanical stability of said support member.

5. The support member of claim 4, wherein total stiffness of the support member is increased due to connection between the bolt and the threaded section of said second member.

6. The support member of claim 1, wherein said first and said second support member components meet with a hermaphroditic tongue-in-groove assembly to lock said first and said second support member components to each other.

7. The support member of claim 1, wherein, said attachment means is characterized in having a higher elastic modulus than the material of the first and the second support member components.

8. The support member of claim 1, wherein said first and second support member components meet with a dovetail assembly to lock said support member components to each other.

9. The support member of claim 1, wherein the attachment means is a bolt or threaded rod.

* * * * *